US008800079B1

(12) United States Patent
Eubank

(10) Patent No.: US 8,800,079 B1
(45) Date of Patent: Aug. 12, 2014

(54) BED COVER HOLDER

(71) Applicant: Doreen Eubank, Aurora, CO (US)

(72) Inventor: Doreen Eubank, Aurora, CO (US)

( * ) Notice: Subject to any disclaimer, the term of this patent is extended or adjusted under 35 U.S.C. 154(b) by 0 days.

(21) Appl. No.: 14/037,667

(22) Filed: Sep. 26, 2013

(51) Int. Cl.
*A47C 21/00* (2006.01)
*A47C 21/02* (2006.01)
*A47C 31/00* (2006.01)

(52) U.S. Cl.
CPC ..... *A47C 31/00* (2013.01); *A47C 21/026* (2013.01); *A47C 21/022* (2013.01)
USPC ..... 5/504.1; 5/507.1; 5/424; 5/425; 5/426; 5/659

(58) Field of Classification Search
USPC ..... 5/424, 425, 426, 659, 504.1, 507.1
See application file for complete search history.

(56) References Cited

U.S. PATENT DOCUMENTS

| | | | | | |
|---|---|---|---|---|---|
| 2,562,333 | A | * | 7/1951 | Ries | 5/504.1 |
| 2,618,789 | A | * | 11/1952 | Kane | 5/505.1 |
| 2,976,546 | A | * | 3/1961 | Owens | 5/504.1 |
| 2,979,736 | A | | 4/1961 | Kemman | |
| 3,241,159 | A | | 3/1966 | Reed | |
| 3,317,932 | A | * | 5/1967 | Gibbons, Sr | 5/505.1 |
| 3,435,469 | A | | 4/1969 | Fricke | |
| 3,885,256 | A | * | 5/1975 | Du Boff | 5/504.1 |
| D273,643 | S | | 5/1984 | Sanker | |
| 5,001,795 | A | * | 3/1991 | Kasten | 5/504.1 |
| 5,305,480 | A | * | 4/1994 | Loren et al. | 5/504.1 |
| 5,426,800 | A | * | 6/1995 | St. John et al. | 5/504.1 |
| D367,385 | S | | 2/1996 | Kasten | |
| 5,652,979 | A | * | 8/1997 | Pugh et al. | 5/504.1 |
| 5,680,660 | A | | 10/1997 | Johanknecht | |
| 5,699,565 | A | | 12/1997 | Petterborg | |
| 5,774,913 | A | * | 7/1998 | Allen et al. | 5/504.1 |
| 6,374,440 | B1 | * | 4/2002 | Thim, Jr. | 5/633 |
| D472,746 | S | * | 4/2003 | Hall | D6/503 |
| 7,096,527 | B2 | | 8/2006 | Malik | |
| D528,842 | S | * | 9/2006 | Wyatt et al. | D6/607 |

* cited by examiner

*Primary Examiner* — William Kelleher
(74) *Attorney, Agent, or Firm* — Leyendecker & Lemire, LLC

(57) ABSTRACT

Bed cover holders having first sections that slide under and between a mattress and a box spring and second sections including upturned ends that are slidably secured to the first sections permitting the holder to telescope between extended and retracted positions are described. The upturned ends of the holders are positioned flush against the end of the mattress when retracted. The holders can be extended to form a shelf where bedding including pillows can be placed when the bed is in use. In at least one variation, the first and second sections comprise nesting tubular structures to facilitate the telescoping arrangement.

14 Claims, 6 Drawing Sheets

BED COVER HOLDER

FIELD OF THE INVENTION

The invention pertains to apparatus to hold and store bedding when the bedding is not in use on an associated bed.

BACKGROUND

Made beds often include comforters, bedspreads, duvets and decorative pillows that may not be used when a person is sleeping in the bed. In some instances the unused bedding is placed, folded or otherwise, on the mattress near the foot of the bed. This is not desirable to many sleepers especially taller ones as the folded bedding interferes with the placement of their feet and creates discomfort. In other instances, the bedding is placed neatly or not so neatly on the floor. This is undesirable as the bedding can pick up dirt from the floor and become soiled. Further, bedding placed on the floor must be picked up and placed back on the bed when the bed is next made.

Blanket/comforter/quilt racks are known that are typically placed on the floor at the foot of the bed. These racks include one or more horizontally disposed spindles over which the bedding is draped. These work well for blankets, comforters, quilts and other flat bedding but do little to solve the problem of storing extra pillows. Additionally, a significant amount of time and effort can be required to properly place and position the bedding on the rack as well as to take it off the rack and reposition it on the bed. Finally, the racks are not easily stored when not in use, and accordingly, often remain at the foot of the bed when unused detracting from the decorum of the made bedroom.

DETAILED DESCRIPTION

Figure 1:
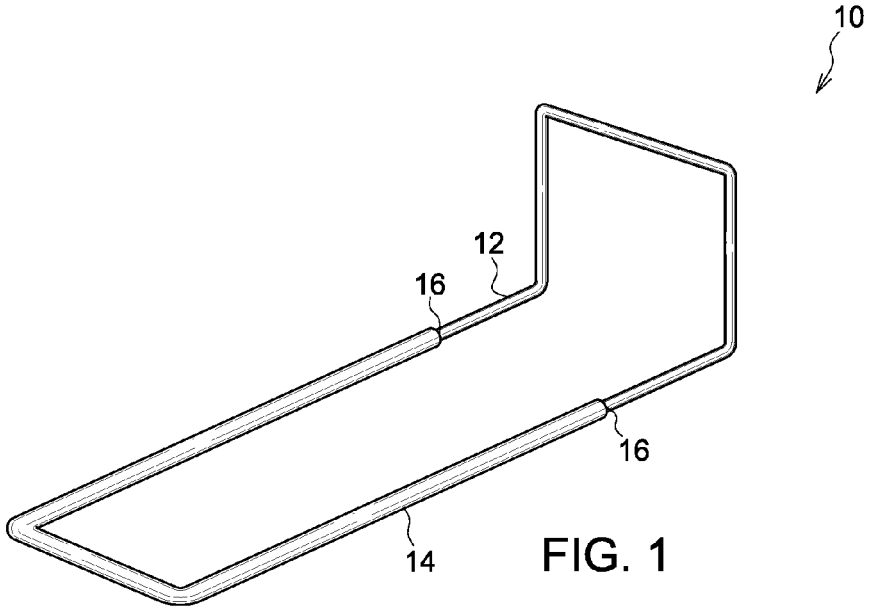
FIG. 1 is a perspective view of the bed cover holder according to one embodiment of the present invention.

Embodiments of the invention comprise holders having first sections that slide under and between a mattress and a box spring and second sections including upturned ends that are slidably secured to the first sections permitting the holder to telescope between extended and retracted positions. Accordingly, the holder can be hidden under a bedspread or other covering when retracted with the upturned ends positioned flush against the end of the mattress. The holder can be extended to form a shelf where bedding including pillows can be placed when the bed is in use. In at least one embodiment, the first and second sections comprise nesting tubular structures to facilitate the telescoping arrangement.

Embodiments of the holder are typically about 12" to 18" wide and multiple units are used to span the width of a bed. For instance, two units are typically used with twin size beds and up to four units with king size beds. The use of multiple units not only ensures the distance between bed covering supporting rungs is not too great to effectively hold the bedding, but also eliminates the need to manufacture differently sized holders for different sizes of bed.

In use a suitable number of holders are placed between a mattress and a box spring with the first section usually nearly completely sandwiched. The units are most often placed at the foot end of the bed with the up turned portion of the second section being located outside of the mattress and box spring intersection. Normally, such as during the day when the bed is not in use, the holder is held in a retracted position with the second sections upturned portion (or end stop portion) resting flush against the end of the mattress. In this configuration, a bed spread or similar cover maybe placed over the holders to shield the holders from view. In yet other instances, the holders may be exposed with the bed coverings located between the mattress and the upturned portion at the end of the bed.

When a person desires to use the bed, he/she can extend each of the second sections by pulling them outwardly relative the first sections to effectively create a shelf along one side of the bed have a width of approximately 12-24" between the bed's end and the upturned portions. The bed coverings the person is not intending to utilize while sleeping can be folded and placed on the effective shelf. Often the outer cover(s) of the bed, such as a bedspread, will be tucked between the mattress and the box spring above the rungs of the first sections such that the cover can be folded and placed on the effective shelf without in tucking the outer cover(s). Given the width between supporting rungs, extra pillows can be placed on the holders either on top of or underneath the folded bed covering(s). Stored as described while the bed is in use, the unused pillows and coverings are easily, quickly and neatly arranged while not coming into contact with a dirty or dusty floor.

TERMINOLOGY

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

An Embodiment of a Bed Cover Holder

As shown in FIGS. 1-7, an embodiment of the bed cover holder 10 comprises two major components: a u-shaped first section 14; and a generally u-shaped second section 12 that includes an upturned portion that extends generally orthogonally relative to a horizontal telescoping or arm portion. Additional minor components (not shown) may also be provided to facilitate the telescoping relationship between the first and second sections.

Figure 2:
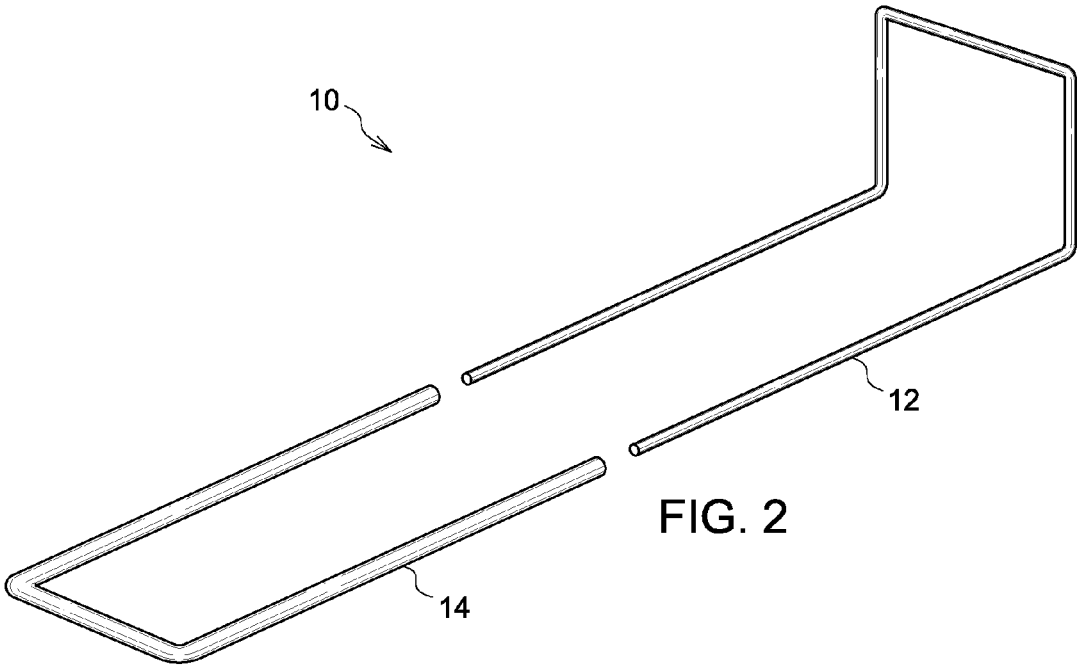
FIG. 2 is an exploded perspective view of the bed cover holder according to one embodiment of the present invention.
Figure 3:
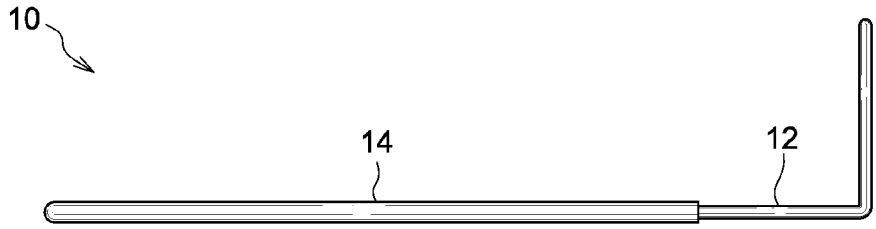
FIG. 3 is a side plan view of the bed cover holder according to one embodiment of the present invention.
Figure 4:
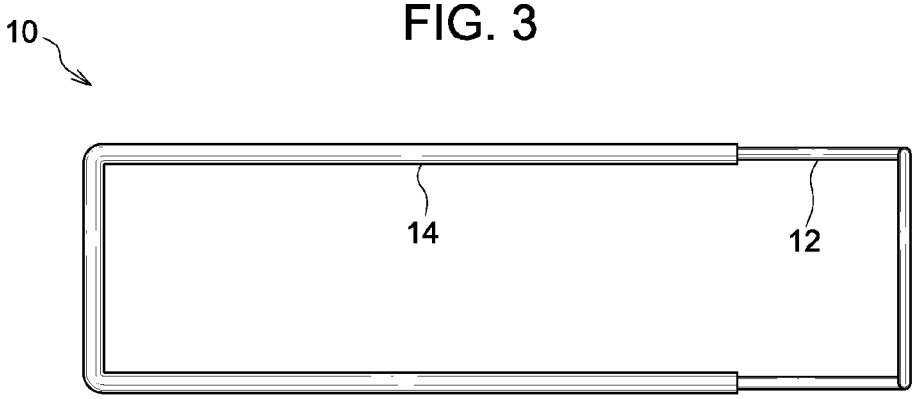
FIG. 4 is a top view of the bed cover holder according to one embodiment of the present invention.
Figure 5:
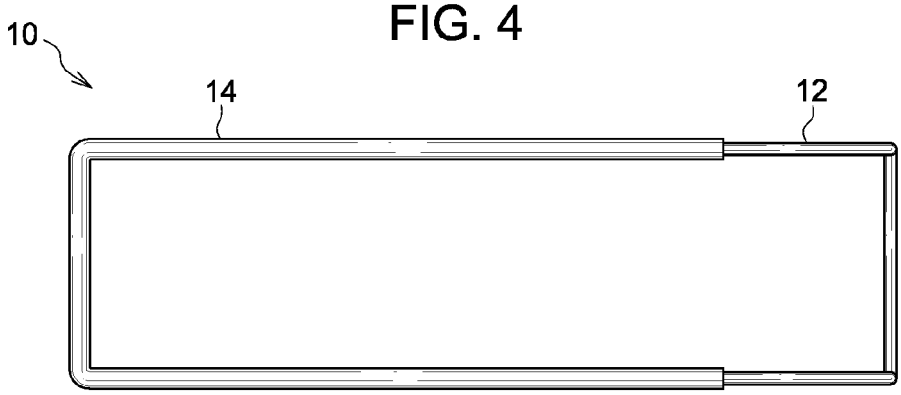
FIG. 5 is a bottom view of the bed cover holder according to one embodiment of the present invention.
Figure 6:
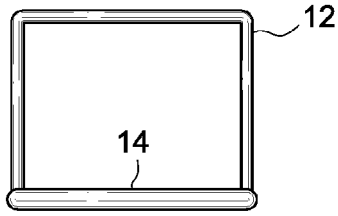
FIG. 6 is a first end view of the bed cover holder according to one embodiment of the present invention.
Figure 7:
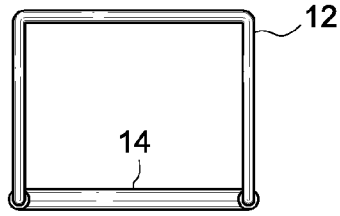
FIG. 7 is a second end view of the bed cover holder according to one embodiment of the present invention.

The first section 14 is best illustrated in FIG. 2. Its u-shape is formed of a cylindrical tubular material. The tube most often comprises metal, more particularly steel or aluminum and even more particularly stainless steel. The metal tubing is bent into the u-shape having a base portion with ends from which respective parallel left and right arm portions extend orthogonally therefrom.

The construction of the first section 14 is not limited to metal but can comprise other suitable materials, such as plastic or even wood. As shown the first section comprises and is constructed of unitary piece but in variations the first section can comprise more than one piece that is joined together to form the first section. Further, the salient design features of the first section are that it is configured for telescoping operation in relation to the second section and it has sufficient length to be held securely between a mattress and a box spring. As would be obvious to someone of ordinary skill in the art to which the invention pertains, the first section may be embodied in a form significantly different than illustrated herein.

The second section 12 is also best illustrated in FIG. 2. It is typically formed from a tube or cylindrical rod material having an outside diameter small enough to be received in the inside diameter of the arms of the first section. The second section can be comprised of similar materials and fabricated by similar means as the first section.

The generally u-shaped second section 14 comprises two parallel arms that are spaced to be received in the arms of the second section. The base portion of the second section differs from that of the first section as the portion of the tube comprising it turns orthogonally upwardly at the intersection with the respective arms and forms upturned portion that is in itself also u-shaped. The upturned portion acts as a stop to prevent bedding and pillows received on the cover from sliding off of it.

As illustrated, the arms of the second section 12 are slidably received into the arms of the first section 14 at the end 16 of the arms of the first section. It is to be appreciated that a variation wherein the second section comprises the larger diameter tubing and the first section is received into the second section is also contemplated. In either configuration, the holder may include bushings, most typically comprised of plastic, to help center and hold the smaller diameter section arms in place in the larger diameter section arms.

Just as with the first section 14, the actual configuration of the second section 12 can vary from the illustrated embodiment. The salient design features of the second section include having an upturned portion or other stop and being configured for telescoping operation in relation to the first section.

In one specific embodiment, the first section comprises 0.50" diameter 304 stainless steel tubing with a 0.035" wall thickness. The second section comprises 0.375" diameter tubing with a 0.049" wall thickness. Since the inside diameter of the first section tube is greater than the outside diameter of the second section tube, the second section arms slide freely in the first section arms. Because the difference between the respective diameters is 0.055", a plastic bushing about 0.020 to 0.025" thick may be used to help center the smaller tube in the larger tube.

In the one specific embodiment the holder is about 13.5" wide with the first section about 34" and the second section about 28" long. The upturned portion of the second section is about 8" tall. The actual lengths and widths of the holder and its sections can vary in other embodiments as can the relative diameters of the tubes. Further, the first section can comprise a smaller tube and the second section can comprise the larger tube with the resulting holder operating and functioning in a substantially similar manner as the illustrated embodiment.

While the illustrated embodiment and the further described one specific embodiment utilize cylindrical tubes in their construction, tubes having square, rectangular and other cross sectional shapes could be employed providing the tubes used in the respective first and second sections are complementary in facilitating the telescoping relationship. The holder need not be comprised of tubes at all. For instance, the first section could comprise a board on which tracks are provided to permit a second section to slide inwardly and outwardly between retracted and extended positions.

A Method of Using Embodiments of a Bed Cover Holder

Figure 9:
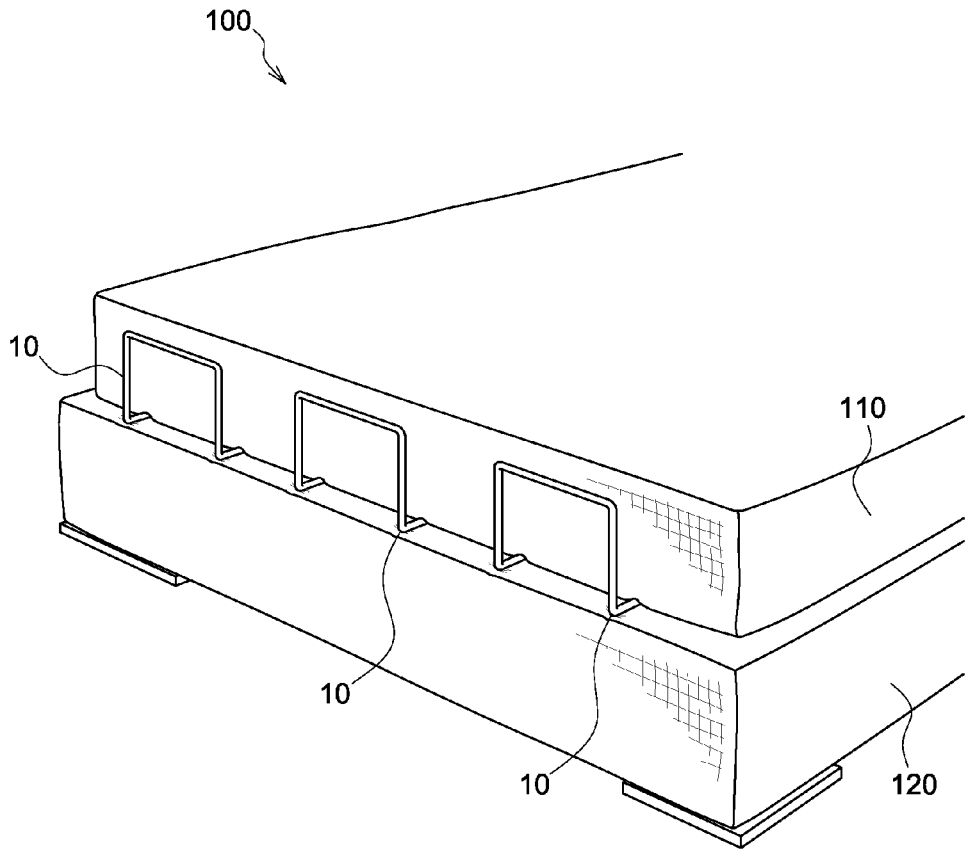
FIG. 9 is a perspective view of several bed cover holders installed on a queen-size bed in a retracted position according to one embodiment of the present invention.
Figure 10:
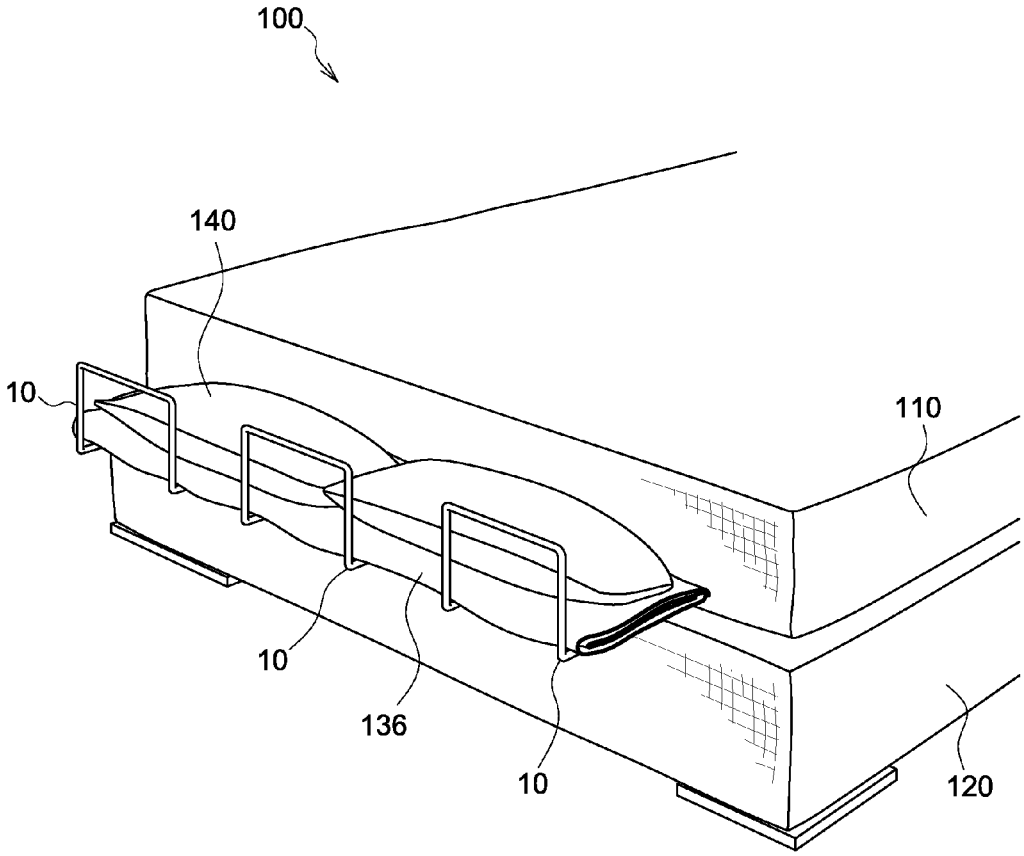
FIG. 10 is a perspective view of several bed cover holders installed on a queen-size bed in an extended position with bed covers and pillows resting thereon according to one embodiment of the present invention.
Figure 11A:
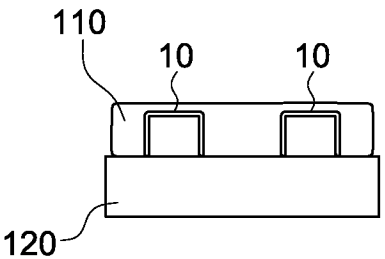
FIG. 11A-C are end views of bed cover holders installed on twin, queen and king sized beds respectively according to one embodiment of the present invention.
Figure 11B:
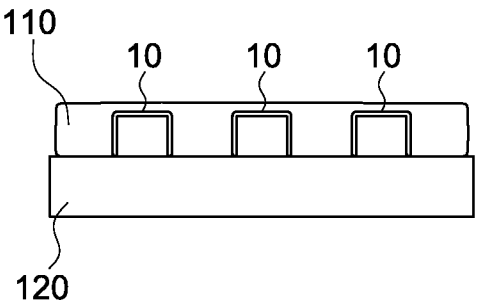
Figure 11C:
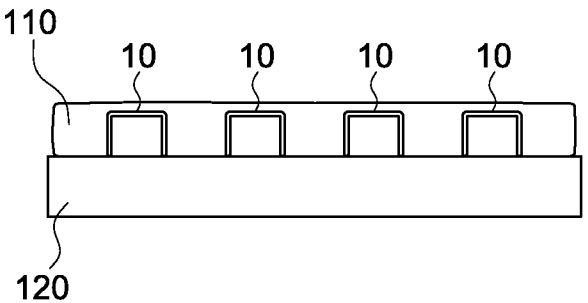

FIGS. 8-11*c* illustrate a plurality of embodiments of the bed cover holders 10 in various states of installation and use. Typically, a plurality of holders is used simultaneously. As indicated above each holder is relatively narrow compared to the width of a bed 100. Accordingly to hold and support the entire width of bedding 130 associated with a particular bed two or more holders should be installed on a particular bed. As shown in FIG. 11A, two 13.5" wide holders are typically used with a twin size bed, which is 39" wide. As shown in FIG. 11B, three 13.5" wide holders are typically used with full and queen size beds, which are 54" and 60" wide respectively. As shown in FIG. 11*c*, four 13.5" wide holders are typically used with a king size bed, which is 76" wide.

Figure 8:
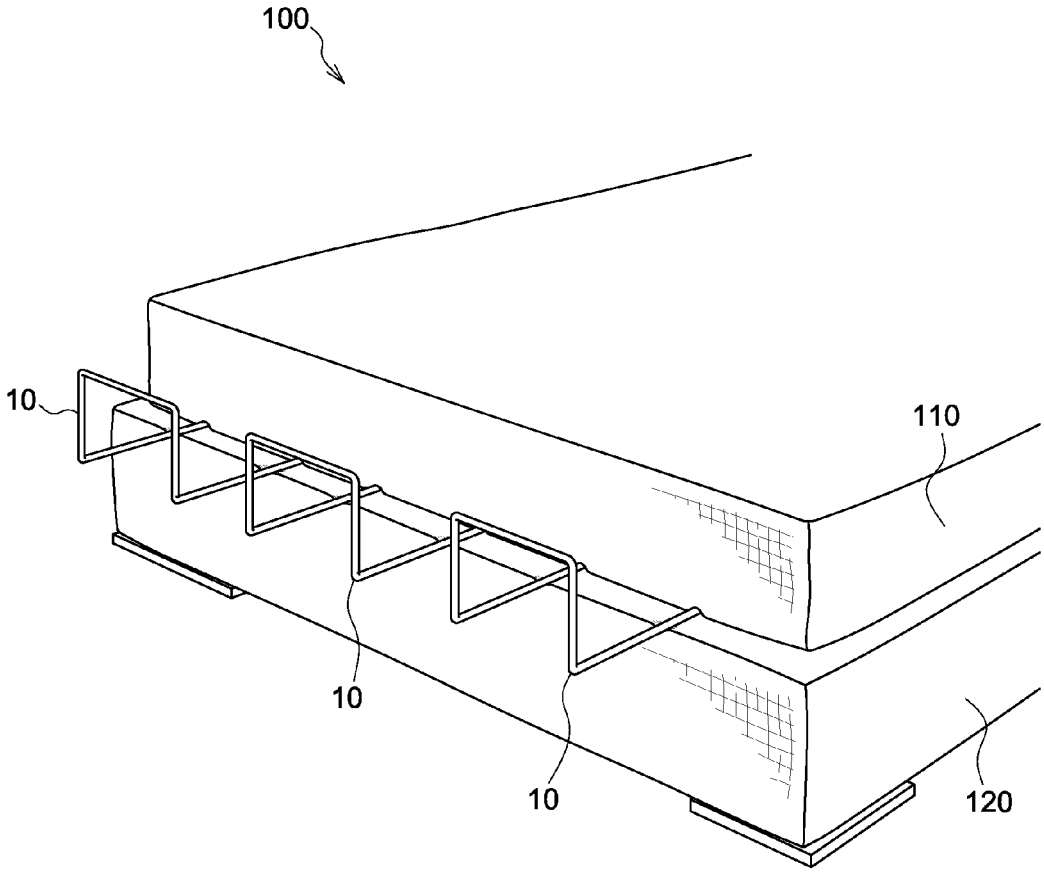
FIG. 8 is a perspective view of several bed cover holders installed on a queen-size bed in an extended position according to one embodiment of the present invention.

As shown in FIGS. 8&9 and as described above, the holder is typically placed at the foot of the bed 100 between a mattress 110 and a box spring 120 with substantially the entirety of the first section being covered by the mattress. In beds not having box springs the holder can be placed between the bottom side of the mattress and the bed's supporting platform.

Generally when first installed and positioned in place, the plurality of holders 10 are in the retracted position with the arms of the second section nearly fully received in the arms of the first section and with the upturned portion positioned flush against the side of the mattress 110 as best shown in FIG. 9. The holders are usually slipped underneath the portions of the sheets and blankets that have been tucked into the end of the mattress. Optionally, they can be placed over a bedspread that has been tucked into the mattress. Alternatively, the entirety of the bedspread, comforter or duvet can be received over and on top of the holders whether tucked into the end of the bed or not. Using the second configuration, the holder is hidden from view when the bed is made.

To use the holders 10 a user simply pulls the second section 12 outwardly away from the end of the mattress to create a shelf. Depending on the embodiment, the second section is typically pulled 12-20" from the end of the bed. The shelf comprising the arms of the second section is bounded by the mattress 110 on one side and the upturned portion on the other. The extended holders as installed one a bed are illustrated in FIG. 8.

Once each of the plurality of holders 10 are extended, the user can drape any bedding he/she is not using there over as shown in FIG. 10. Pillows 140 may also be placed on the holders either directly or on top of the draped bedding 130.

In the morning or whenever the user makes his/her bed, the bedding 130 is lifted off of the holders 10 and positioned as desired over/on the bed 100. The holders are then simply pushed back into the retracted position. As indicated and mentioned above, a user may drape a bedspread or duvet over the exposed upturned portions.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A method of storing bedding when the bedding is not covering or lying on the bed using a plurality of bed cover holders, the method comprising:

providing a plurality bed cover holders, each bed cover holder comprising, a first section, the first section comprising a u-shaped tube with an outside diameter and an inside diameter, the u-shaped tube having a first base portion with a pair of parallel spaced apart first arm portions extending orthogonally therefrom, and a second section, the second section comprising (i) a modified u-shaped tube having an outside and inside diameters with a pair of parallel second arm portions spaced apart a distance complementary to the spaced apart distance of the pair of first arm portions, (ii) a u-shaped base portion intersecting with proximal ends of the respective second arms and extending generally vertically relative to horizontal second arm portions, wherein one of the first and second arm portions are telescopically received in the other of the first and second arm portions facilitating movement between the first and second sections from retracted position and an extended position, the length of the holder in the retracted position being at least 8" shorter than the holder in the extended position;

installing each of the plurality of holders on the bed by placing the first section substantially between a mattress and a box spring of the bed at the foot end with the second arms of the second section received in the first arms, each holder being adjacent to at least one neighboring holder;

sliding the second section of each holder outwardly of the first section to move the holder from the retracted position to the extended position; and placing folded bedding on and across the second arms of the plurality of holders each in the extended position.

2. The method of claim 1, wherein the bedding includes at least one pillow.

3. The method of claim 1, wherein the plurality of holders consists of three holders and the bed is a queen size bed.

4. The method of claim 1, wherein the plurality of holders consists of four holders and the bed is a king size bed.

5. The method of claim 1, wherein the plurality of holders consists of two holders and the bed is a twin size bed.

6. In combination, a plurality of bed cover holders, a bed having a box spring and a mattress, at least one from the group of a bedspread, a duvet, a blanket and a comforter wherein each of the plurality of bed holders is installed adjacent to at least one other bed holder between the box spring and the mattress at a foot end of the bed and the at least one of the group of the bedspread, the duvet, the blanket and the comforter being folded, spanning across and resting on the plurality of bed cover holders, each bed cover holder comprising:

a first section, the first section comprising a u-shaped tube with an outside diameter and an inside diameter, the u-shaped tube having a first base portion with a pair of parallel spaced apart first arm portions extending orthogonally therefrom; and a second section, the second section comprising (i) a modified u-shaped tube having an outside and inside diameters with a pair of parallel second arm portions spaced apart a distance complementary to the spaced apart distance of the pair of first arm portions, (ii) a u-shaped base portion intersecting with proximal ends of the respective second arms and extending generally vertically relative to horizontal second arm portions;

wherein one of the first and second arm portions are telescopically received in the other of the first and second arm portions facilitating movement between the first and second sections from retracted position and an extended position, the length of the holder in the retracted position being at least 8" shorter than the holder in the extended position.

7. The combination of claim 6, wherein the plurality of bed holders are deployed in their extended position, and the at least one the group of the bedspread, the duvet, the blanket and the comforter are received on the first arms of each holder.

8. The method of claim 1, wherein the first and second sections of each bed holder comprise stainless steel.

9. The method of claim 1, wherein the inside diameter of the first section of each bed holder is greater than the outside diameter of the second section of each bed holder.

10. The method of claim 1, wherein the width of each bed holder is 12-15".

11. The method of claim 1, wherein each bed holder is at least 33" in length in the retracted position.

12. The method of claim 1, wherein each bed holder is capable of being at least 45" in length in the extended position.

13. The method of claim 1, wherein the height of the upturned portion of each bed holder is at least 6".

14. The method of claim 1, wherein the bedding includes one of a bedspread, a duvet and a comforter.

* * * * *